US011125002B2

(12) United States Patent
Pavlovic et al.

(10) Patent No.: US 11,125,002 B2
(45) Date of Patent: Sep. 21, 2021

(54) WINDOW REGULATOR RAIL AND MOTOR SUPPORT WITH INTERMEDIATE HIGH STRENGTH CONNECTOR

(71) Applicant: MAGNA CLOSURES INC., Newmarket (CA)

(72) Inventors: Milos Pavlovic, Kleinburg (CA); Vesna Pavlovic, Kleinburg (CA)

(73) Assignee: MAGNA CLOSURES INC., Newmarket (CA)

( * ) Notice: Subject to any disclaimer, the term of this patent is extended or adjusted under 35 U.S.C. 154(b) by 47 days.

(21) Appl. No.: 16/683,035

(22) Filed: Nov. 13, 2019

(65) Prior Publication Data

US 2020/0149336 A1 May 14, 2020

Related U.S. Application Data

(60) Provisional application No. 62/760,954, filed on Nov. 14, 2018.

(51) Int. Cl.
*E05F 11/38* (2006.01)
*E05F 11/48* (2006.01)

(52) U.S. Cl.
CPC ..... *E05F 11/483* (2013.01); *E05F 11/382* (2013.01); *E05Y 2201/684* (2013.01); *E05Y 2900/55* (2013.01)

(58) Field of Classification Search
CPC ..... E05F 11/382; E05F 11/385; E05F 11/483; E05Y 2201/684; E05Y 2201/654; E05Y 2201/66; E05Y 2800/272; E05Y 2201/658; E05Y 2800/676; E05Y 2900/55;

(Continued)

(56) References Cited

U.S. PATENT DOCUMENTS 4,648,208 A * 3/1987 Baldamus ..... B60J 5/0416 49/502
6,516,493 B1 * 2/2003 Seliger ..... E05F 11/486 16/96 R (Continued)

FOREIGN PATENT DOCUMENTS

CA 2449516 C 3/2008
CN 2698629 Y 5/2005

(Continued)

OTHER PUBLICATIONS

Chinese Office Action from the Chinese Patent Office for related Chinese Application No. 201911113158.9 dated Feb. 3, 2021.

*Primary Examiner* — Chi Q Nguyen
(74) *Attorney, Agent, or Firm* — Dickinson Wright PLLC

(57) ABSTRACT

A carrier module for a motor vehicle and door assembly therewith is provided. The carrier module includes a pair of carrier members, each extending lengthwise between opposite first and second ends. The carrier members are operably coupled to one another via at least one cable, wherein at least one of the carrier members is formed of plastic material and includes at least one of, a plurality of weight reduction through openings bounded by strength and rigidity enhancing walls, at least one non-planar side having weight reduction, strength and rigidity enhancing undulations, and a plurality of strength and rigidity enhancing ribs bounding weight reduction recessed pockets.

20 Claims, 15 Drawing Sheets

(58) Field of Classification Search
CPC ..... E05Y 2800/682; E05Y 2800/27; E05Y 2800/292; E05Y 2800/296; E05Y 2800/33
USPC ..... 49/348, 352, 349, 501, 502
See application file for complete search history.

(56) References Cited

U.S. PATENT DOCUMENTS

| | | | | |
|---|---|---|---|---|
| 7,121,044 | B2 * | 10/2006 | Santaolalla Gil | E05F 11/486 49/352 |
| 7,596,908 | B2 | 10/2009 | Rothe et al. | |
| 7,743,555 | B2 | 6/2010 | Smith | |
| 7,975,434 | B2 | 7/2011 | Smith | |
| 8,096,080 | B2 | 1/2012 | Pavlovic et al. | |
| 8,127,493 | B2 | 3/2012 | Cappelli et al. | |
| 8,353,129 | B2 | 1/2013 | Nakanishi et al. | |
| 8,844,198 | B2 | 9/2014 | Raisoni et al. | |
| 8,943,665 | B2 | 2/2015 | Walawender et al. | |
| 9,821,636 | B2 * | 11/2017 | Kriese | B29C 45/14 |
| 10,287,814 | B2 | 5/2019 | Fortin | |
| 2004/0060240 | A1 * | 4/2004 | Fellner | B60J 5/0463 49/349 |
| 2006/0290166 | A1 | 12/2006 | Gehringhoff et al. | |
| 2007/0180773 | A1 | 8/2007 | Fortin et al. | |
| 2007/0277441 | A1 | 12/2007 | Smith et al. | |
| 2008/0005971 | A1 | 1/2008 | Dickie et al. | |
| 2009/0193718 | A1 | 8/2009 | Tudora et al. | |
| 2009/0223133 | A1 | 9/2009 | Miu et al. | |
| 2009/0282744 | A1 | 11/2009 | Jung | |
| 2011/0010999 | A1 | 1/2011 | Broadhead et al. | |
| 2011/0107676 | A1 * | 5/2011 | Rietdijk | E05F 11/382 49/358 |
| 2011/0126467 | A1 * | 6/2011 | Scharf | E05F 11/483 49/348 |
| 2013/0097932 | A1 * | 4/2013 | Kriese | E05F 11/481 49/376 |
| 2013/0098183 | A1 | 4/2013 | Fever et al. | |
| 2013/0199098 | A1 * | 8/2013 | Kriese | E06B 3/44 49/417 |
| 2013/0219794 | A1 | 8/2013 | Nakamura et al. | |
| 2014/0250790 | A1 * | 9/2014 | Huelsebusch | E05F 15/689 49/349 |
| 2015/0352927 | A1 * | 12/2015 | Kriese | E05D 15/165 49/352 |
| 2017/0342756 | A1 | 11/2017 | Fortin | |
| 2018/0354349 | A1 * | 12/2018 | Fortin | B60J 5/0418 |
| 2019/0078366 | A1 | 3/2019 | Lu et al. | |
| 2020/0123832 | A1 | 4/2020 | Bose et al. | |

FOREIGN PATENT DOCUMENTS

| | | | |
|---|---|---|---|
| CN | 1665694 | A | 9/2005 |
| CN | 103210166 | A | 7/2013 |
| CN | 103924860 | A | 7/2014 |
| CN | 103270235 | B | 8/2015 |
| CN | 107444081 | A | 12/2017 |
| DE | 102013113795 | A1 | 6/2014 |
| EP | 1586279 | A1 | 10/2005 |
| EP | 1698503 | B1 | 10/2005 |
| EP | 1728957 | B1 | 8/2010 |
| ES | 2654516 | T3 | 2/2018 |
| FR | 2883514 | A3 | 9/2006 |
| JP | 2003306037 | A | 10/2003 |
| WO | 2004035336 | A1 | 4/2004 |

* cited by examiner

WINDOW REGULATOR RAIL AND MOTOR SUPPORT WITH INTERMEDIATE HIGH STRENGTH CONNECTOR

CROSS-REFERENCE TO RELATED APPLICATION

This application claims the benefit of U.S. Provisional Application Ser. No. 62/760,954, filed Nov. 14, 2018, which is incorporated herein by way of reference in its entirety.

FIELD

The present disclosure relates generally to vehicle door assemblies, and more particularly to a carrier module of a door assembly having a carrier member with widow regulator rail fixed to a motor support by an integral high strength intermediate connector.

BACKGROUND

This section provides background information related to the present disclosure which is not necessarily prior art.

In many motor vehicle door assemblies, an outer sheet metal door panel and an inner sheet metal door panel are connected together to define an internal door cavity therebetween. An equipment module or sub-assembly, commonly referred to as a carrier module, or simply carrier, is often mounted to the inner door panel within the internal door cavity. The carrier typically functions to support various door hardware components, including window regulator rails configured to support lifter plates for selectively slidable movement therealong, as well as a window regulator motor, often simply referred to as window regulator, to drive the lifter plates along the window regulator rails. The lifter plates are fixed to a window to cause the window to slide up and down therewith along the direction of guide channels within the window regulator rails in response to powered actuation of the window regulator.

In vehicles that require so called "frameless" doors, such as are commonly used on convertibles, the carriers are typically bulky, heavy, solid fabrications of complex metal components due to the need to power and support the lifter plates for guided movement along the window regulator rails, as well as for the need to provide suitable support to, and resist deflection of, the window regulator as it drives the lifter plates along the window regulator rails. Further, the ability of the window to resist flexing or bending deflection, such as while being placed under a load during a door closing/slamming event or in an up-stall condition, is important to avoid glass breakage or misalignment. As such, the carrier generally, and the components thereof, such as the window regulator rails and a support region of the window regulator, need to be robust and relatively stiff to withstand the forces and energy encountered during use, and to withstand the stresses and bending moments on the window regulator rails and lifter plates/glass interface. As such, the carrier, window regulator rails and lifter plates are typically formed of solid, impervious sheets or fabrications of steel and heavy die-cast components in order to withstand the challenging environment of a frameless door. Unfortunately, the metal components are not only bulky and heavy, but are also costly in manufacture.

In view of the above, there is a need to provide a carrier module for a frameless door that is high strength, robust, stiff and durable, while at the same time being lightweight and economical in manufacture and assembly.

SUMMARY

This section provides a general summary of the disclosure and is not intended to be a comprehensive listing of all features, advantages, aspects and objectives associated with the inventive concepts described and illustrated in the detailed description provided herein.

It is an object of the present disclosure to provide a carrier that addresses at least some of those issues discussed above with known carriers.

In accordance with the above object, it is an aspect of the present disclosure to provide a carrier that is high strength, robust, stiff and durable, while at the same time being lightweight and economical in manufacture and assembly.

In accordance with one aspect, the present disclosure is directed to a carrier for a motor vehicle door assembly. The carrier includes a pair of carrier members operably coupled to one another via at least one cable. The carrier members are configured for substantially free movement relative to one another to facilitate installation of the carrier members into an internal door cavity of the motor vehicle door assembly. At least one of the carrier members is formed having a window regulator rail region configured to support a window regulator rail and a window regulator support region configured to support a window regulator, with a connector region interconnecting the window regulator rail region and the window regulator support region, with the connector region being formed of plastic, thereby being lightweight and economical in manufacture.

In accordance with another aspect of the disclosure, the connector region, window regulator rail support region, and the window regulator support region are formed as a monolithic piece of plastic, thereby being lightweight and economical in manufacture.

In accordance with another aspect of the disclosure, the at least one carrier member having the window regulator support region can be formed as an A-pillar carrier member.

In accordance with another aspect of the disclosure, the at least one carrier member having the window regulator support region can be formed as a B-pillar carrier member.

In accordance with another aspect of the disclosure, the window regulator rail support region can be formed having a window regulator rail formed as a monolithic piece of plastic material therewith.

In accordance with another aspect of the disclosure, the connector region can be formed having at least one non-planar, undulating side to reduce the weight, material content and cost of the carrier member and to enhance the strength and rigidity of the carrier member.

In accordance with another aspect of the disclosure, the connector region can be formed having non-planar, undulating opposite sides to further reduce the weight, material content and cost of the carrier member.

In accordance with another aspect of the disclosure, the undulating opposite sides can be formed having a wavy, sinuous corrugated shape.

In accordance with another aspect of the disclosure, the corrugated shape can have peaks and valleys extending lengthwise between upper and lower ends of the carrier member to enhance the strength and flexural stiffness of the carrier member to resist deflection of the carrier member as a window is raised and lowered along a window regulator rail of the carrier member.

In accordance with another aspect of the disclosure, the carrier member can having a uniform material thickness extending between the undulating opposite sides to reduce the weight, material content and cost of the carrier member.

In accordance with another aspect of the disclosure, the intermediate connector region can be formed having a plurality of through openings to reduce the weight, reduce the material content and reduce the cost of the carrier member.

In accordance with another aspect of the disclosure, the plurality of through openings can be bounded by a honeycomb patterned wall to reduce the weight and enhance the strength and rigidity of the carrier member.

In accordance with another aspect of the disclosure, the honeycomb patterned wall can have a plurality of adjacent columns of through openings extending lengthwise between upper and lower ends of the carrier member to reduce the weight and enhance the strength and rigidity of the carrier member.

In accordance with another aspect of the disclosure, the honeycomb patterned wall can isolate the window regulator support region in spaced relation from the window regulator rail region, thereby reducing the weight, material content and cost of the carrier member.

In accordance with another aspect of the disclosure, the window regulator rail support region can be formed having at least one side including a plurality of ribs bounding recessed pockets to reduce the weight, material content and cost of the carrier member and to enhance the strength and rigidity of the carrier member.

In accordance with another aspect of the disclosure, the window regulator rail support region can be formed having opposite sides including a plurality of ribs bounding recessed pockets to reduce the weight, material content and cost of the carrier member and to enhance the strength and rigidity of the carrier member.

In accordance with another aspect of the disclosure, the plurality of ribs bounding recessed pockets can be located adjacent the upper and lower ends to provide enhanced support about mounting points for pulleys and to strengthen a connection between the upper and lower ends and a body of the window regulator rail.

In accordance with another aspect of the disclosure, a carrier module for a motor vehicle having inner and outer panels defining a door panel structure with an internal door cavity, the carrier module includes a pair of carrier members each extending lengthwise between opposite first and second ends. The carrier members are operably coupled to one another via at least one cable, wherein at least one of the carrier members is formed of plastic material and includes at least one of, a plurality of weight reduction through openings bounded by strength and rigidity enhancing walls, at least one non-planar side having weight reduction, strength and rigidity enhancing undulations, and a plurality of ribs bounding recessed pockets.

In accordance with another aspect of the disclosure, the present disclosure is directed to a door assembly for a motor vehicle configured to include an outer panel, an inner panel, and a carrier. The outer panel and the inner panel, when connected together, form a door panel structure that is configured to define an internal door cavity. The carrier includes a pair of carrier members operably coupled to one another via at least one cable. The carrier members are configured for substantially free movement relative to one another to facilitate installation of the carrier members into the internal door cavity through the opening formed in the inner panel. At least one of the carrier members is formed having a window regulator rail region configured to support a window regulator rail and a window regulator support region configured to support a window regulator, with an integral connector region extending between the window regulator rail region and the window regulator support region, with the connector region being formed of a monolithic piece of plastic with the window regulator rail support region and the window regulator support region, thereby being lightweight and economical in manufacture.

In accordance with another aspect of the disclosure, the present disclosure is directed to a method of constructing a carrier member for a carrier module for a motor vehicle door panel structure. The method includes molding a plastic body having a first end configured to support an upper pulley and a second end configured to support a lower pulley and having a window regulator rail support region configured to support a window regulator rail and a window regulator support region configured to support a window regulator, with a connector region interconnecting the window regulator rail support region and the window regulator support region. The method further includes molding the connector region including at least one of, a plurality of through openings bounded by walls and at least one non-planar side having undulations.

In accordance with another aspect of the disclosure, the method can further include molding the connector region as a monolithic piece of plastic with the window regulator rail support region and the window regulator support region and including the plurality of through openings bounded by the walls.

In accordance with another aspect of the disclosure, the method can further include molding the connector region as a monolithic piece of plastic with the window regulator rail support region and the window regulator support region and including the at least one non-planar side having undulations.

In accordance with another aspect of the disclosure, the method can further include molding the connector region including opposite non-planar sides each having the undulations forming a corrugated shape.

In accordance with another aspect of the disclosure, there is provided a carrier member for a carrier module of a motor vehicle door panel structure, the carrier member including a body extending lengthwise between a first end configured to support an upper pulley and a second end configured to support a lower pulley, the body including at least one non-planar side having undulations enhancing weight reduction, strength and rigidity of the carrier member. In accordance with a related aspect of the carrier member, the undulations extend lengthwise between the first end and the second end. In accordance with another related aspect of the carrier member, the being is formed of plastic material. In accordance with another related aspect of the carrier member, the plastic material includes glass fibers. In accordance with another related aspect of the carrier member, the body includes radially extending ribs about a mounting point for each pulley. In accordance with another related aspect of the carrier member the at least one non-planar side includes non-planar, undulating opposite sides having a corrugated shape. In accordance with yet another related aspect of the carrier member, the corrugated shape has peaks and valleys extending lengthwise between upper and lower ends of the carrier member. In accordance with still another related aspect of the carrier member, the undulations have uniform material thickness extending between opposite sides of the carrier member.

Further areas of applicability will become apparent from the description provided herein. The description and specific examples in this summary are only intended to illustrate certain non-limiting embodiments which are not intended to limit the scope of the present disclosure.

BRIEF DESCRIPTION OF THE DRAWINGS

The drawings described herein are for illustrative purposes only of selected non-limiting embodiments and are not intended to limit the scope of the present disclosure. In this regard the drawings include.

DETAILED DESCRIPTION OF PRESENTLY PREFERRED EMBODIMENTS

Figure 1:
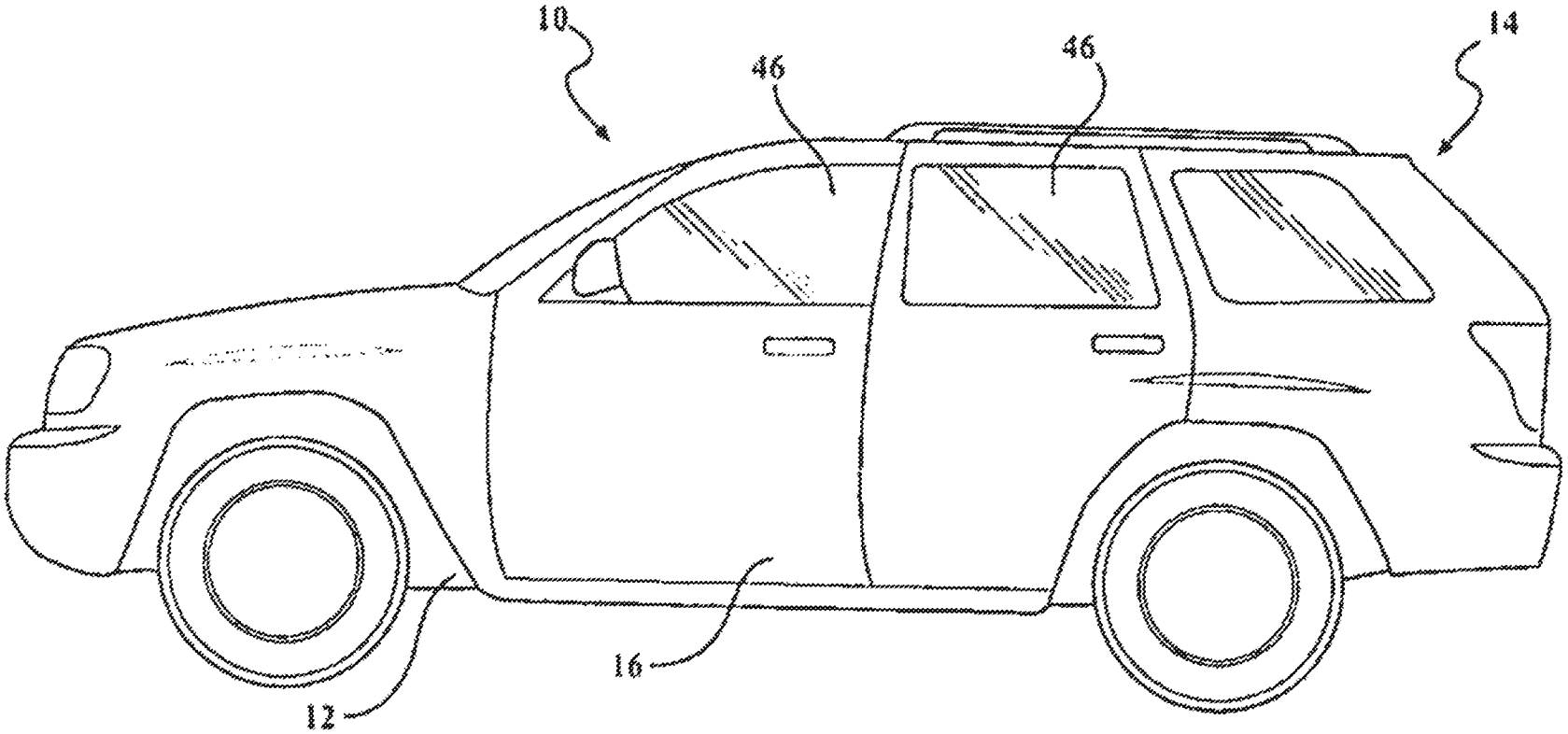
FIG. 1 illustrates a motor vehicle with a door assembly in accordance with an aspect of the disclosure.

An example embodiment of a motor vehicle closure panel and carrier module therefor will now be described more fully with reference to the accompanying drawings. To this end, the example embodiment of the carrier module is provided so that this disclosure will be thorough, and will fully convey its intended scope to those who are skilled in the art. Accordingly, numerous specific details are set forth such as examples of specific components, devices, and methods, to provide a thorough understanding of a particular embodiment of the present disclosure. However, it will be apparent to those skilled in the art that specific details need not be employed, that the example embodiment may be embodied in many different forms, and that the example embodiment should not be construed to limit the scope of the present disclosure. In some parts of the example embodiment, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom", and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

Figure 3:
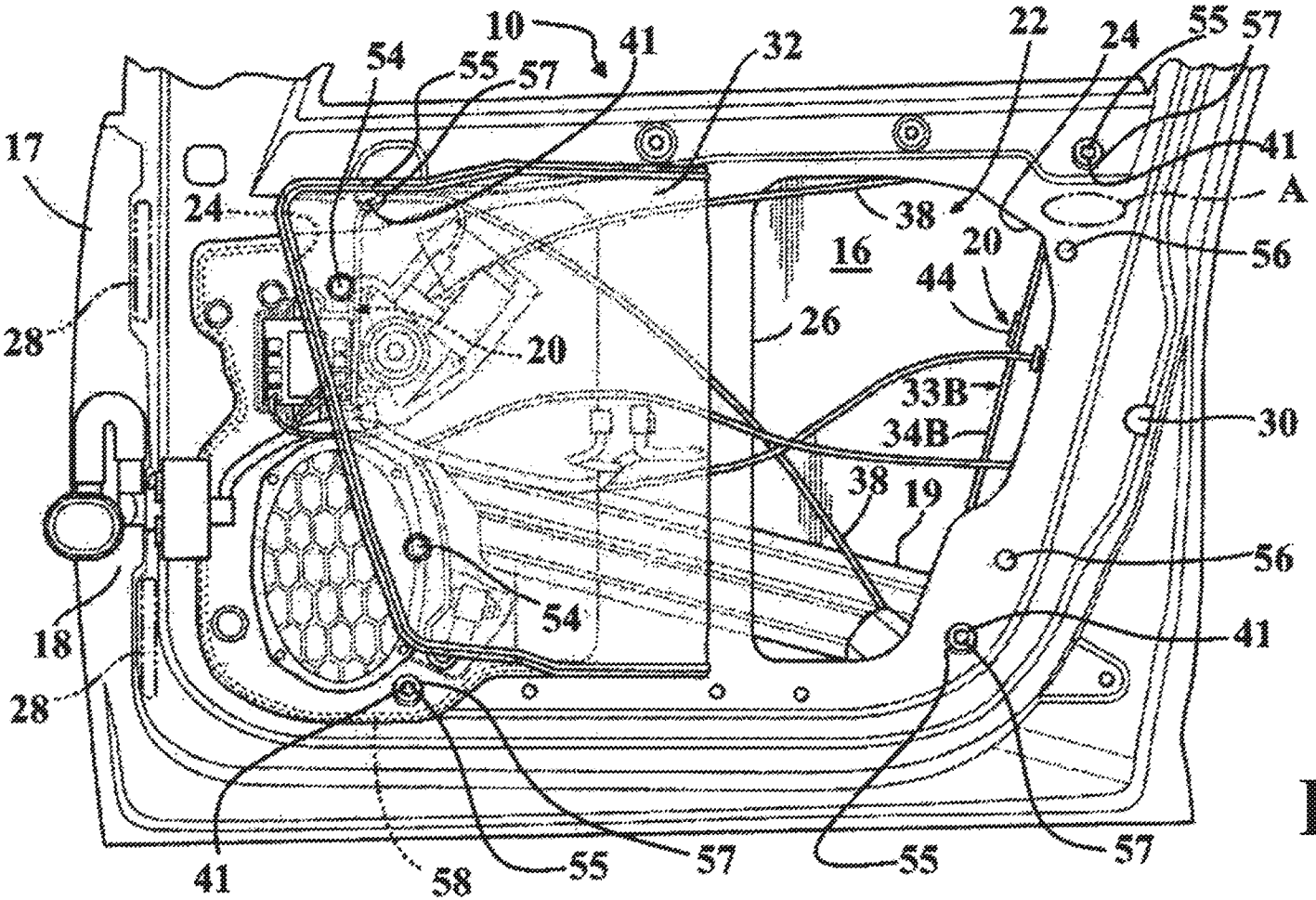
FIG. 3 illustrates the carrier module of FIG. 2 shown assembled to the door assembly of FIG. 1 with the barrier folded back.

Reference is made to FIG. 1, which shows a door assembly 10 mounted to a body 12 of a motor vehicle 14. The door assembly 10 includes an outer panel 16, an inner panel 18 (FIG. 3), an intrusion member 19 and a frameless door carrier module, referred to hereafter simply as carrier 20, shown constructed in accordance with one presently preferred aspect of the disclosure. The carrier 20, for reasons discussed further hereafter, is high strength, robust, stiff and durable, while at the same time being lightweight and economical in manufacture and assembly.

The outer panel 16 forms at least part of the exterior surface of the door assembly 10. The inner panel 18 provides a structural member for the mounting of one or more trim pieces that form an inner surface of the door assembly 10. Some of the inner panel 18 may itself also form part of the inner surface of the door assembly 10, if desired. The outer and inner panels 16, 18 are connected together to provide a door panel structure 17 that forms an internal door cavity 22 (FIG. 3) that contains various components of the door assembly 10, including at least a portion of the carrier 20. To facilitate assembly of the components into the cavity 22, the inner panel 18 has at least one, and shown as a pair of openings 24, by way of example and without limitation. The openings 24 are shown as being formed on opposite sides of the inner panel 18 with a central support member or rail 26 extending therebetween. The central support rail 26 can be formed as an integral, monolithic piece of material with the inner panel 18, thereby rendering the inner panel 18 economical in manufacture and enhancing the structural integrity, strength and side impact resistance of the inner panel 18. Due to the ability of at least some of the carrier module components, discussed separately hereafter, to be moved relative to one another, and due to the relatively small size of the individual components of the carrier 20, in comparison to the size of the assembled carrier 20, as discussed in more detail below, and further due to the ability to maintain at least a portion of the carrier 20 externally from the internal door cavity 22, the size of the individual openings 24 needed in the inner panel 18 for assembly of the carrier 20 can be minimized. As such, the amount of material and area of material forming the inner panel 18 can be maximized, thereby increasing the side impact strength of the inner panel 18 relative to inner panels having substantially larger central openings and reduced area.

The outer and inner panels 16, 18 may be made from any suitable material or combination of materials. For example, the outer and inner panels 16, 18 may both be made from a suitable metal (e.g. a suitable steel). In another example, the outer panel 16 may be made from a suitable polymeric or composite material (e.g. fiberglass) and the inner panel may be made from a suitable metal, by way of example and without limitation.

A pair of hinges 28 are connected to door panel structure 17 and pivotally mount a front end of door panel structure 17 (and door assembly 10) to the vehicle body 12. A door latch 30 is mounted to the rear end of door panel structure 17 to permit the releasable closure of door assembly 10 against vehicle body 12. Hinges 28 and door latch 30 act as force transfer members through which forces in door assembly 10 are transmitted to vehicle 14. Such forces include, for example, side-impact forces from another vehicle or object colliding with the vehicle 14.

The carrier 20 is shown having a barrier member, shown as being a collapsible barrier member 32, by way of example and without limitation, attachable to a pair of respective A and B-pillar carrier members 33A, 33B of carrier 20, though their orientation could be reversed, if desired. The carrier members 33A, 33B have a pair of window regulator rail support regions 31A, 31B that are configured to support a pair of window regulator rails, including, respectively, an A-pillar window regulator rail 34A and a B-pillar window regulator rail 34B, and a plurality of door hardware components operably mounted to the carrier members 33A, 33B. In this non-limiting example, at least some of the door hardware includes a power-operated window regulator 36 having an electric motor-driven cable 38 entrained about upper pulleys 40 supported for rotation adjacent upper ends of each carrier member 33A, 33B and lower pulleys 42 supported for rotation adjacent lower ends of each carrier member 33A, 33B. Pulleys 40, 42 may be connected directly to the sheet metal of the inner panel 18, for example by a fastener 41 extending through the pulley center e.g. a center bore to engage with the inner panel 18 e.g. a threaded receiving aperature 55 in the inner panel 18 or for passage through an aperture in the inner panel 18 for securing to a connector 57 such as a nut as an example. Inner panel 18 due to the thickness of the inner panel 18 sheet metal may deflect and may not be sufficient alone to resist the loadings the carrier member 33A, 33B are subjected. Alternatively or additionally, carrier member 33A, 33B may be secured to the inner panel 18 at other mounting points provided on the carrier member 33A, 33B, such as on the 79, 179 for example. Alternatively or additionally, carrier member 33A, 33B may be secured indirectly to the inner panel 18 and be mounted to a carrier, where the carrier is configured to be directly mounted to the inner panel 18. A pair of lifter plates 44 are supported for sliding movement along the separate window regulator rails 34A, 34B for moving a window 46 upwardly and downwardly within a pair of glass run channels 48, wherein the glass run channels 48 can be provided separately or formed integrally as a single piece of material with the A and B-pillar carrier members 33A, 33B, such as in a molding operation, by way of example and without limitation. Other hardware components shown are well understood by those skilled in the art, and thus, need no explanation, in addition to other components that can be provided, but are not shown. The teachings herein may be applied to other configurations of carriers having rails, such as the rails described in International Patent Application WO 2013/023280 entitled "Window regulator module having carrier plate forcing arcuate rails to acquire helical twist" and in US Patent Application No. US2018/0354349 entitled "Door assembly with split carrier module" and in US Patent Application No. US2017/0314306 entitled "Door assembly with collapsible carrier" as examples and without limitation, and which are incorporated herein by way of reference in their entireties.

Figure 2:
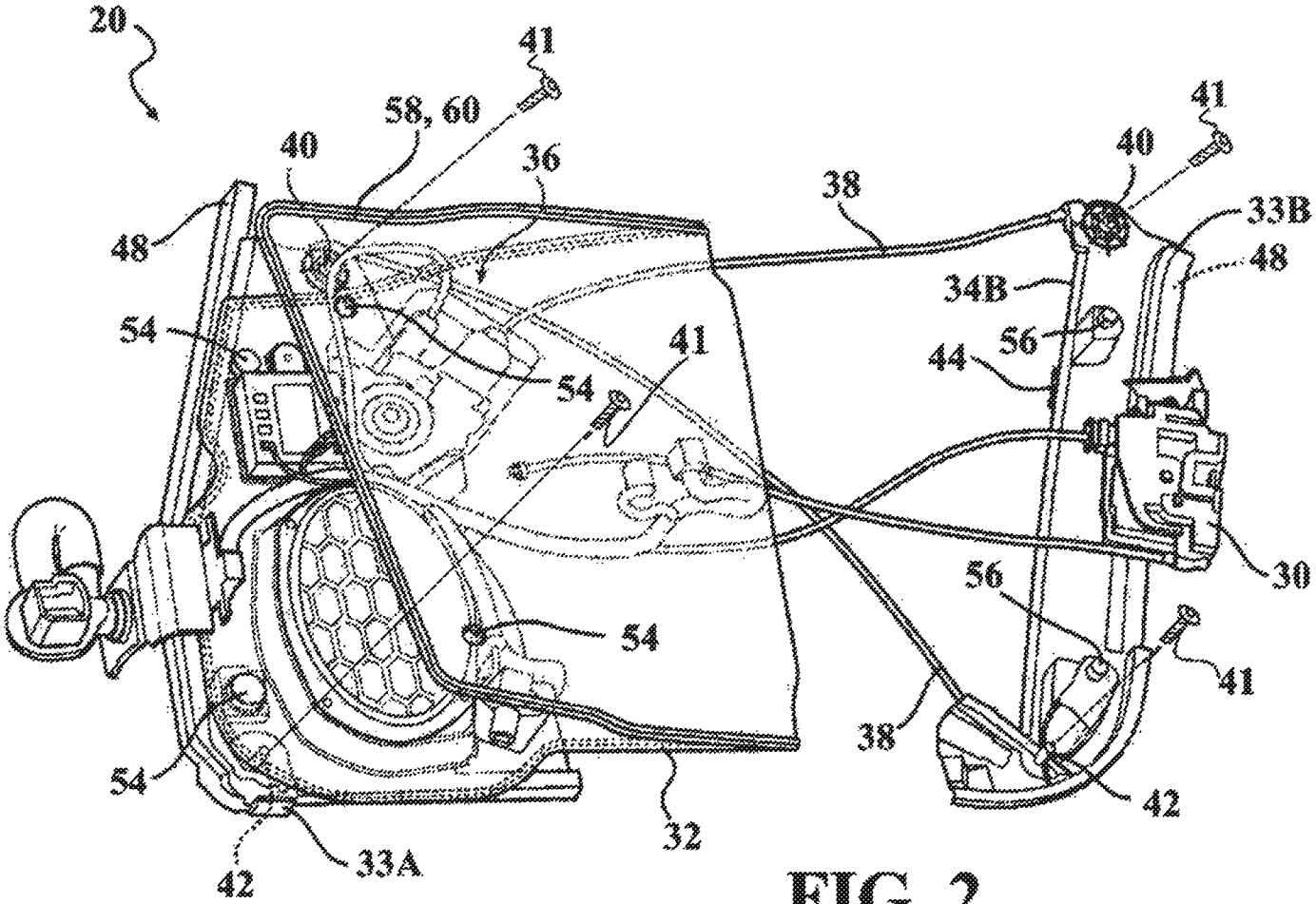
FIG. 2 illustrates a carrier module and barrier of the door assembly of FIG. 1 constructed in accordance with one aspect of the disclosure.
Figure 4:
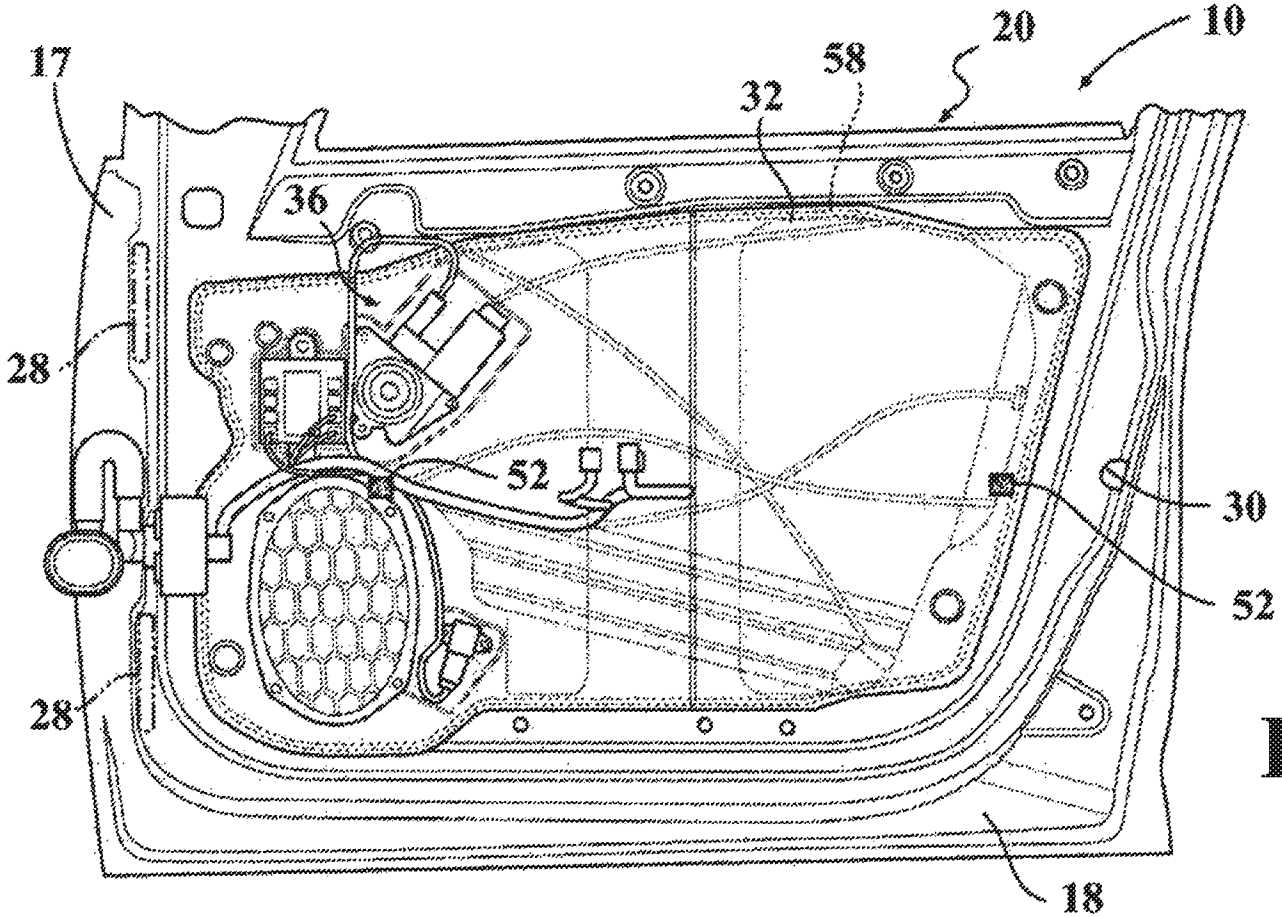
FIG. 4 illustrates the carrier module and barrier of FIG. 2 shown fully assembled to the door assembly of FIG. 1.

In accordance with a non-limiting embodiment, barrier member 32, intended to function both as a fluid (water) barrier and as a sound barrier, can be formed of any suitable fluid/sound barrier material, as desired, in order to meet the necessary specifications. Further, in order to facilitate assembly, including ensuring the barrier member 32 is properly located and fixed in sealed relation relative to the inner panel 18, the barrier member 32 can be formed with locating features 54, shown by way of example as female recesses, configured for mating engagement with corresponding locating features 56, shown by way of example an male protrusions (FIGS. 2-4), on at least one of the separate carrier members 33A, 33B. The locating features 54, 56 can be formed to provide a snug, interference fit with one another.

In accordance with a further non-limiting embodiment, A-pillar carrier member 33A and B-pillar carrier member 33B can have a body B constructed entirely of plastic, thereby being relatively lightweight as compared to a similar structure made of metal, e.g. steel, and also being economical in manufacture, such as via a molding process, by way of example and without limitation, as well as being rigid and durable. The construction of the A-Pillar carrier member 33A and/or B-Pillar carrier member 33B, up till the disclosure and findings herein, are typically known in the art to not be constructed entirely, or even substantially from plastic, due to the high loads placed on the carrier members 33A, 33B, such as can be amplified via movement of the window 46. However, due to the structural features discussed hereafter, A-Pillar carrier member 33A and B-Pillar carrier member 33B can be constructed entirely of plastic, such as in a molding operation, as discussed further hereafter. Such plastic material may include glass fibers 71.

Figure 5:
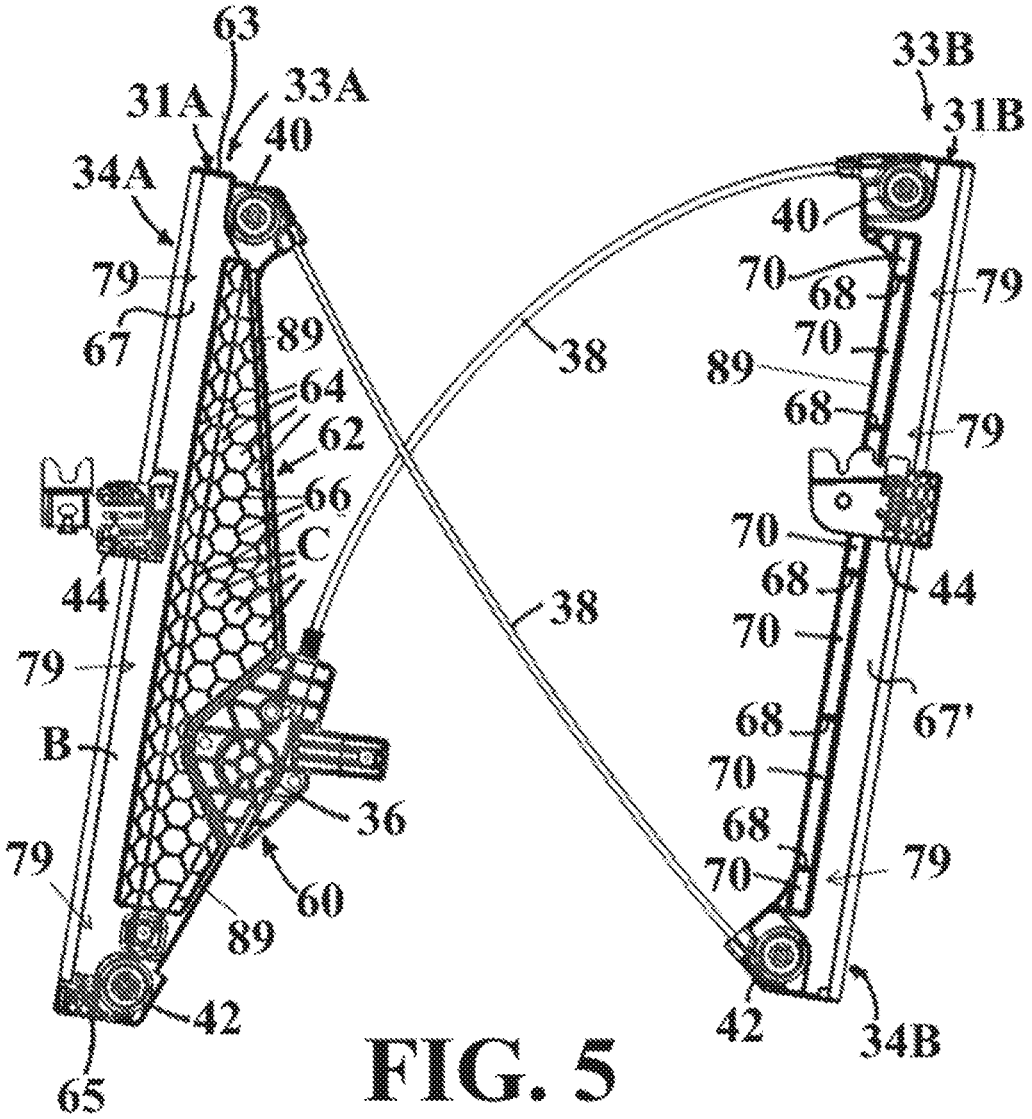
FIG. 5 illustrates a front side elevation view of a carrier module in accordance with one aspect of the disclosure.
Figure 6:
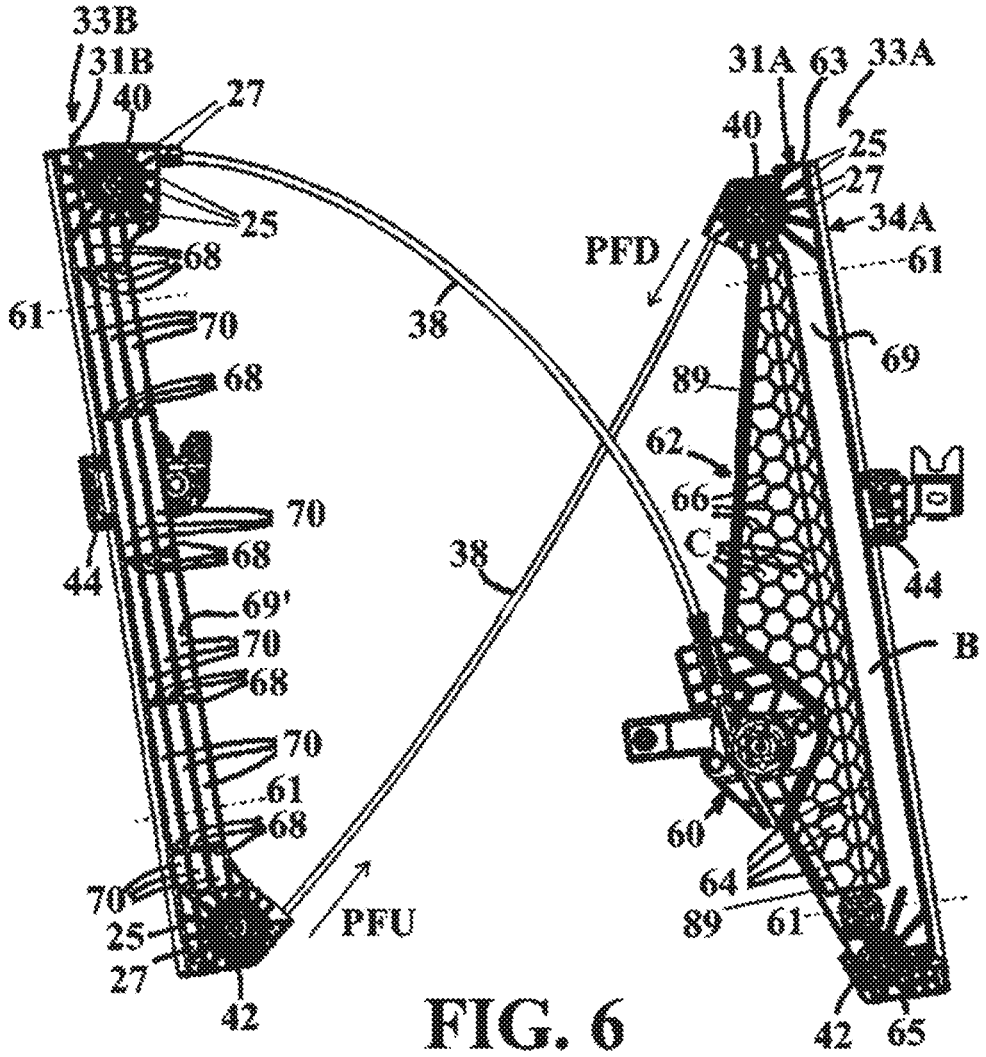
FIG. 6 illustrates a rear side elevation view of the carrier module of FIG. 5.
Figure 6A:
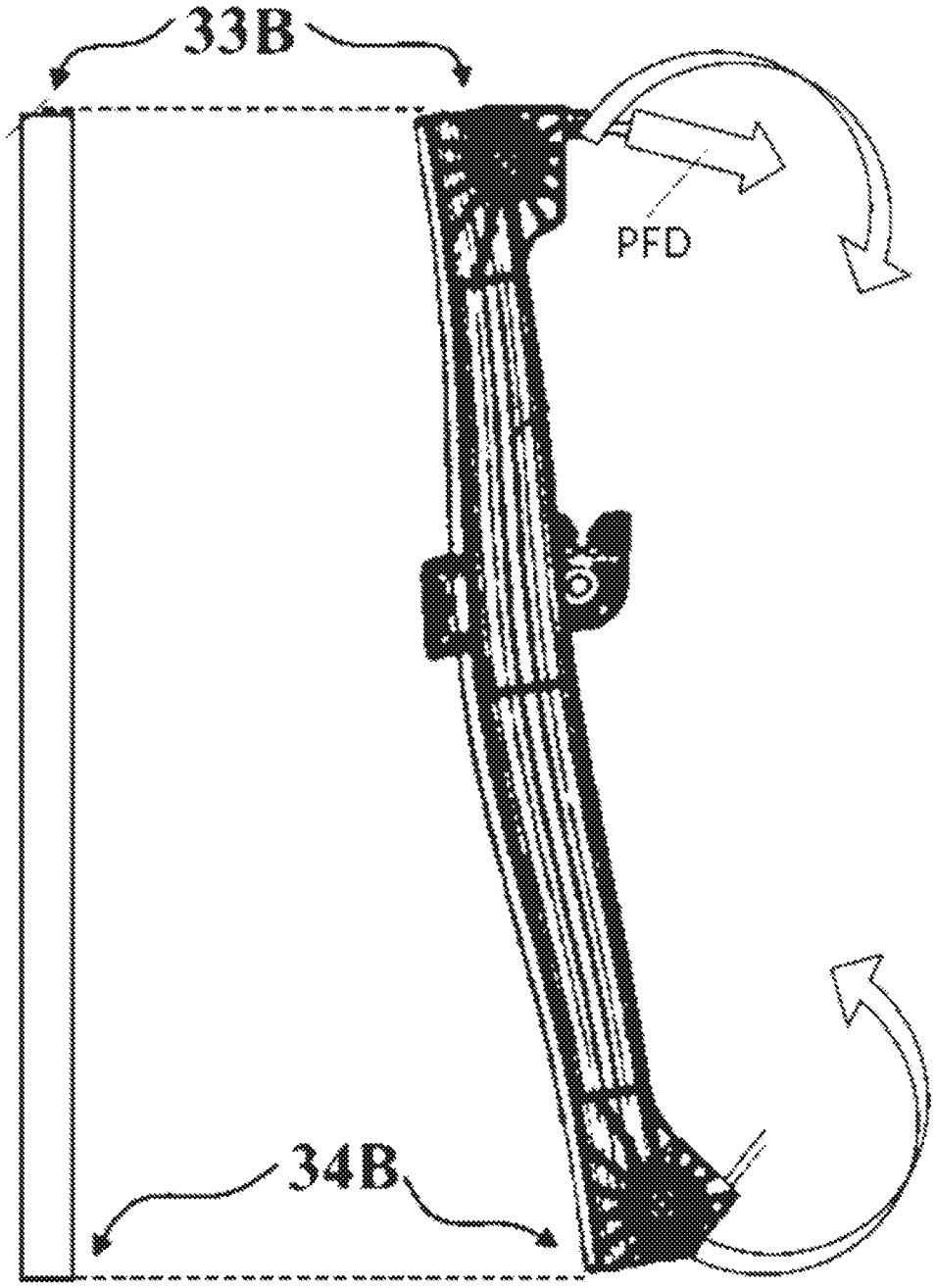
FIGS. 6A to 6C illustrate side views of a rail under loading causing bending, twisting, and bucking of the rail.
Figure 6B:
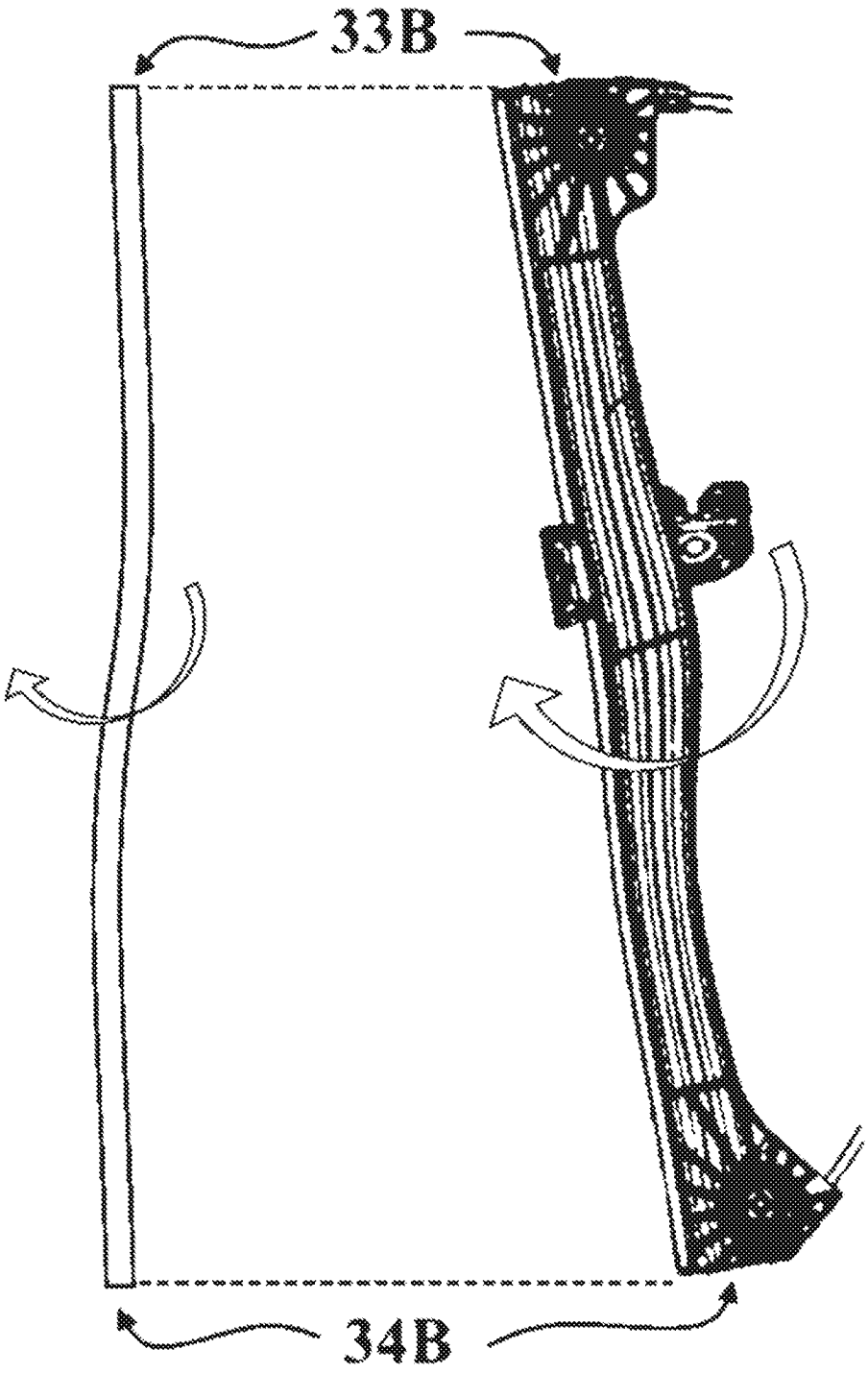
Figure 6C:
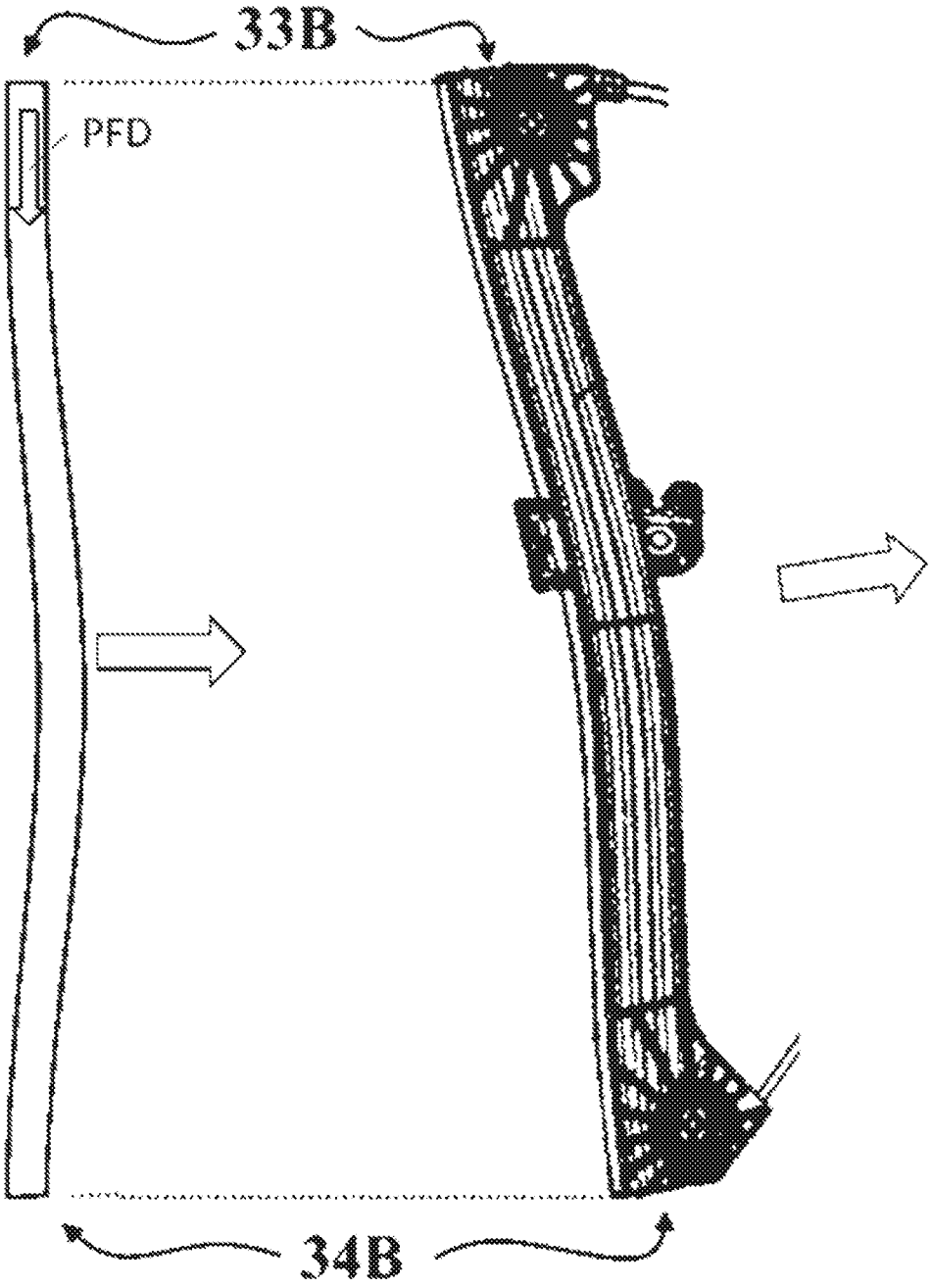

As shown in FIGS. 5 and 6, in accordance with one aspect, window regulator rail support region 31A is constructed as a monolithic piece of material with a corresponding body B of window regulator rail 34A. A window regulator support region 60 is configured to support the window regulator 36, with an integral connector region 62 extending intermediately between the window regulator rail support region 31A and the window regulator support region 60 to fixedly couple window regulator rail support region 31A to the window regulator support region 60. The connector region 62 is formed as a monolithic piece of plastic material with the window regulator rail support region 31A and the window regulator support region 60, such as in a molding process, thereby contributing to the carrier member 33A being lightweight and economical in manufacture. During an upward stall condition, whereby lifter plate 44 reaches its end of travel along rail 34B, pulling force PFU (FIG. 6) acting on pulley 42 via cable 38 actuation by power-operated window regulator 36 will increase the loading on the rail 34B tending to impart at least one of a bending of the rail 34B (see. FIG. 6A), a twisting of the rail 34B (FIG. 6B), and a collapsing vertical loading forcing the rail 34B to buckle (see FIG. 6C). In addition, as the rail 34B may be mounted about a mounting point 61 on the rail 34B displaced from an upper end 63 and a lower end 65, such deformations and forces may occur on the rail 34B portion between the upper and lower ends 63, 65 and mounting point 61. During a downward stall condition, whereby lifter plate 44 reaches its end of travel along rail 34A, pulling force PFD acting on pulley 42 via cable 38 actuation by power-operated window regulator 36 operating in the opposite direction pulling force PFU will increase the loading on the rail 34B tending to impart at least one of a bending, twisting and buckling of the rail 34B in a similar manner as described for PFU on rail 34B.

In accordance with another aspect of the disclosure, the connector region 62 can be formed having a plurality of through openings 64 to further reduce the weight, reduce the plastic material content and reduce the cost of the carrier member 33A. The plurality of through openings 64 can be bounded by relative thin walls 66 of the plastic material, wherein the walls 66 are shown configured in a honeycomb patterned wall configuration to both reduce the weight, while at the same time, enhance the strength and rigidity of the carrier member 33A. The honeycomb patterned walls 66 can be arranged as desired to provide optimal strength and rigidity for the intended application, wherein the pattern depicted, by way of example and without limitation, has a plurality of adjacent columns C of the through openings 64 extending lengthwise along a body of the carrier member 33A between respective upper and lower ends 63, 65 of the carrier member 33A. The honeycomb patterned connector region 62 can isolate the entirety of the window regulator support region 60 in spaced relation from the entirety of the window regulator rail support region 31A, thereby reducing the weight, material content and cost of the carrier member 33A, while at the same time fixing the location of window regulator support region 60 relative to regulator rail support region 31A. Surrounding the honeycomb patterned connector region 62 is a frame 89 formed from a solid plastic component member, for resisting the loading (PFU and PFD) during a stall, as well as torsional loading caused by the window regulator 36 during driving of the cable 38, where such a loading is more likely to be subjected along the outer perimeter of the patterned connector region 62. Such a frame 89 may be provided to surround undulating opposite sides 167, 169 (as shown in accordance with another aspect in FIGS. 7-9) formed having a plurality of undulations 72 in a manner as will be described in more detail below. Frame 89 is illustratively shown as creating a generally triangular structure with regulator rail support region 31A, with the regulator 36 mounted at the apex, also referred to as pinnacle of the triangular structure of frame 89. It is contemplated herein that other than configuring the walls 66 having a honeycomb pattern, other moldable patterns could be used, such as an array of circular, non-circular, triangular, and rectangular walls, or any other geometric configuration of walls desired.

Figure 6D:
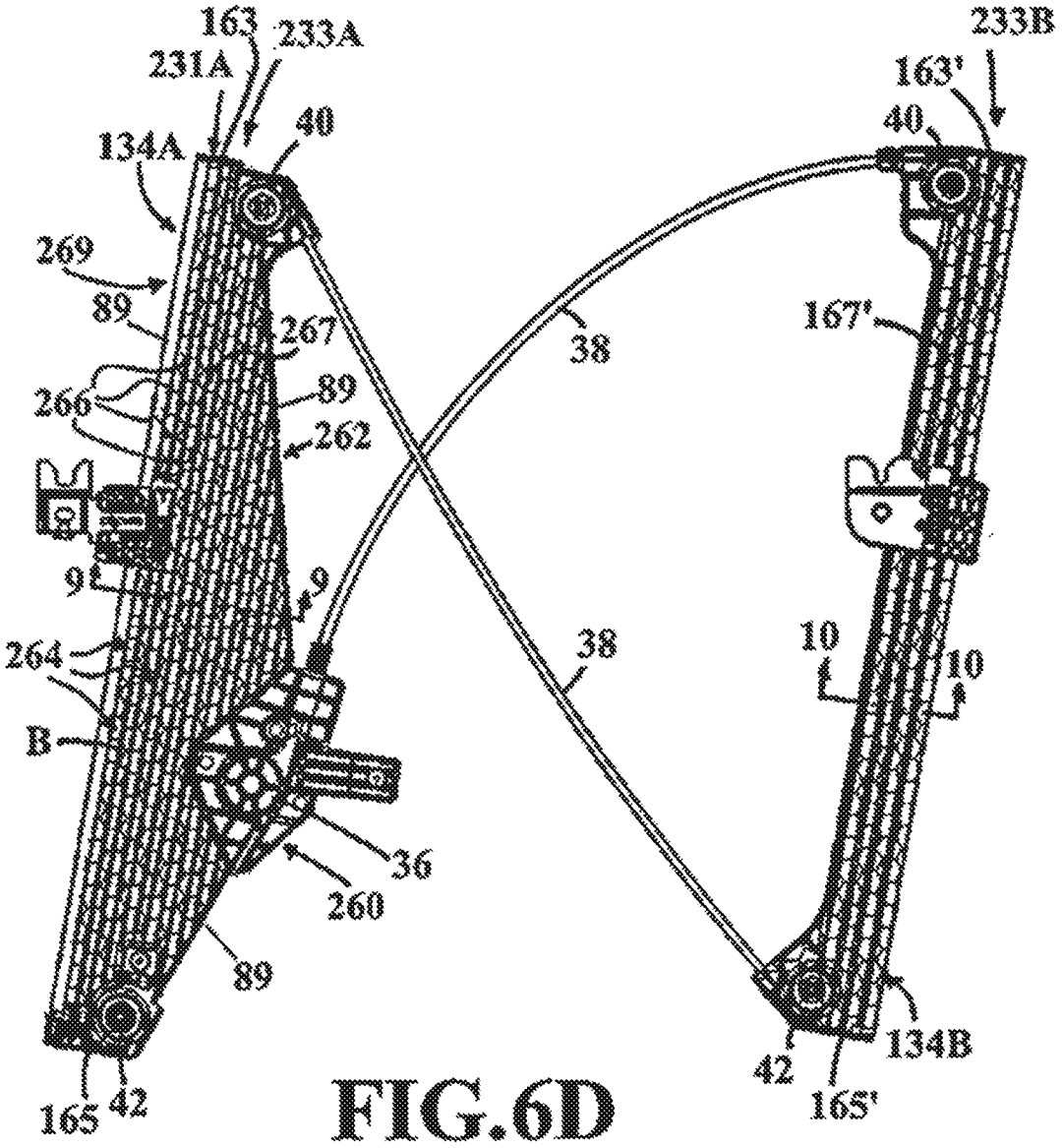
FIG. 6D illustrates a perspective view of a carrier member of a carrier module in accordance with another aspect of the disclosure.

It is also contemplated herein, as shown in FIG. 6D, that the height of the walls 266 bounding through openings 264 and extending between the opposite sides 267, 269 of a body B of carrier member 233A constructed in accordance with another aspect of the disclosure could vary continuously and/or in stepped fashion between the window regulator rail support region 231A and the window regulator support region 260. Accordingly, a non-planar, undulating, also referred to as wavy, surface contour could be provided along at least one or both of the opposite sides 267, 269 of the connector region 262, thereby further reducing the plastic material content and weight in regions of valleys, while maintaining the high strength and rigidity of the carrier member 233A. Otherwise, carrier member 233A can be constructed the same as discussed above for carrier member 33A, and thus, In accordance with another aspect of the disclosure, window regulator rail support region 31B of carrier member 33B is constructed as a monolithic piece of material with corresponding window regulator rail 34B. The window regulator rail support region 31B can be formed having at least one or both sides 67', 69' including a plurality of laterally outwardly extending ribs 68 bounding recessed cavities, also referred to as pockets 70, to reduce the weight, material content and cost of the carrier member 33B and to enhance the strength and rigidity of the carrier member 33B. In an embodiment shown, by way of example and without limitation, each of the opposite sides 67', 69' include a plurality of ribs 68 bounding recessed pockets 70 to reduce the weight, material content and cost of the carrier member and to enhance the strength and rigidity of the carrier member. The recessed pockets 70 in the opposite sides 67', 69' can be mirrored opposite one another or staggered in offset relation with one another, as desired. If staggered, the pockets 70 in the opposite sides 67', 69' can be staggered in their entirety, such that the pockets 70 on one side 67' do not overlap at all the pockets 70 on the opposite side 69', or, the pockets 70 in the opposite sides 67', 69' can be partially staggered, such that the pockets 70 on one side 67' overlap in part the pockets 70 on the opposite side 69'. The mirrored pockets 70 provide maximum weight reduction, while the entirely offset pockets 70 provide enhanced rigidity, while the partially offset pockets 70 provide a balance of reduced weight and enhanced rigidity.

Figure 7:
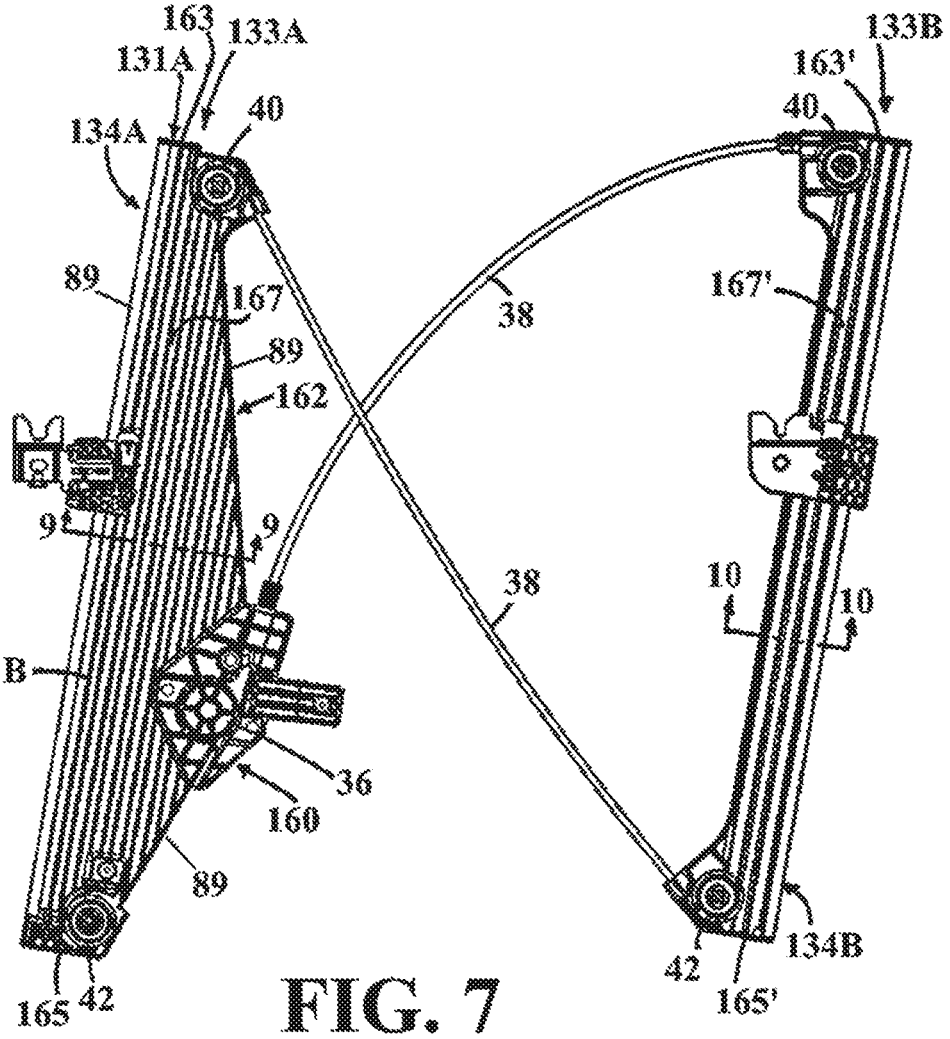
FIG. 7 illustrates a front side elevation view of a carrier module in accordance with another aspect of the disclosure.
Figure 8:
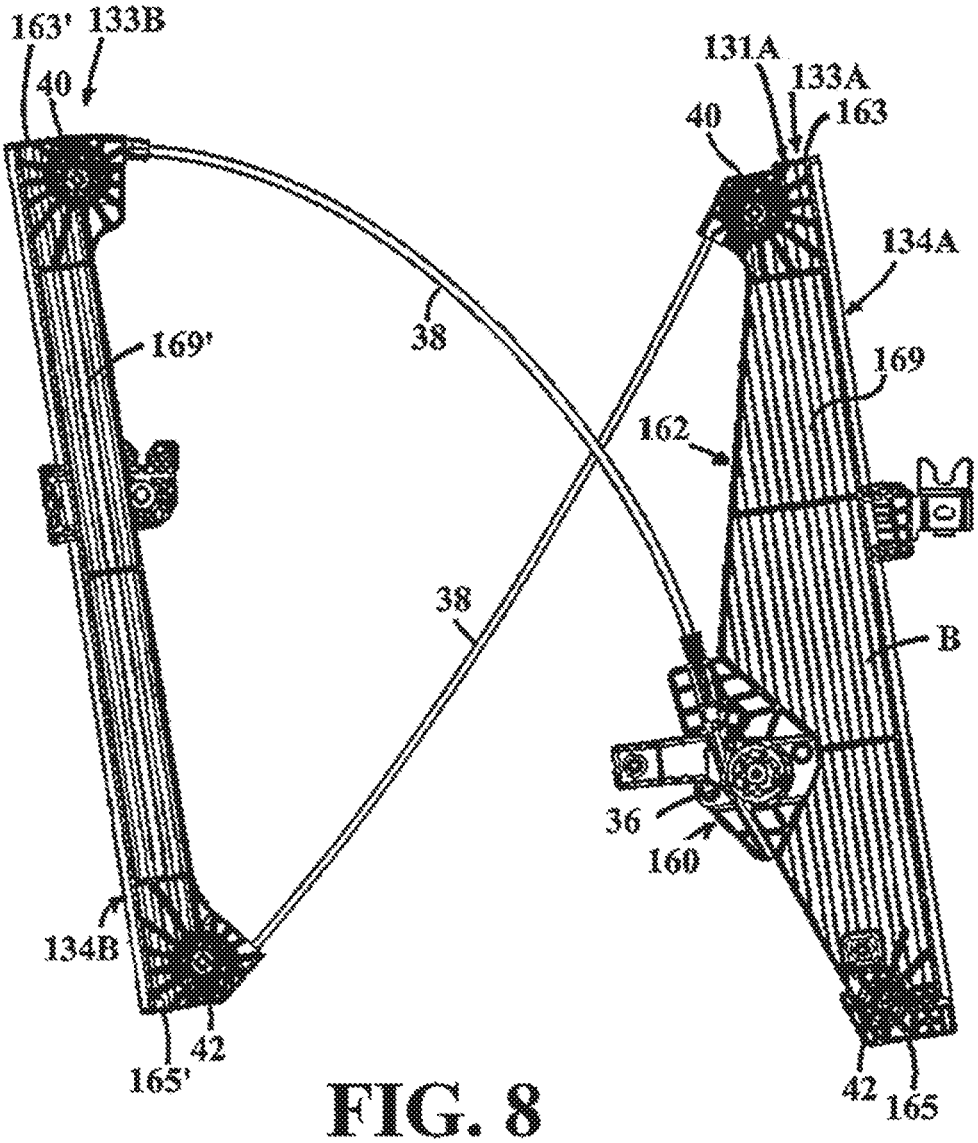
FIG. 8 illustrates a rear side elevation view of the carrier module of FIG. 7.

As shown in FIGS. 7 and 8, carrier members 133A, 133B are shown in accordance with another aspect, wherein the same reference numerals as used above, offset by a factor of 100, are used to identify like features. Carrier member 133A includes a window regulator rail support region 131A that is constructed as a monolithic piece of material with corresponding window regulator rail 134A. A window regulator support region 160 is configured to support the window regulator 36, with an integral intermediate connector region 162 extending between the window regulator rail support region 131A and the window regulator support region 160. The connector region 162 is formed as a monolithic piece of plastic material with the window regulator rail support region 131A and the window regulator support region 160.

Figure 9:
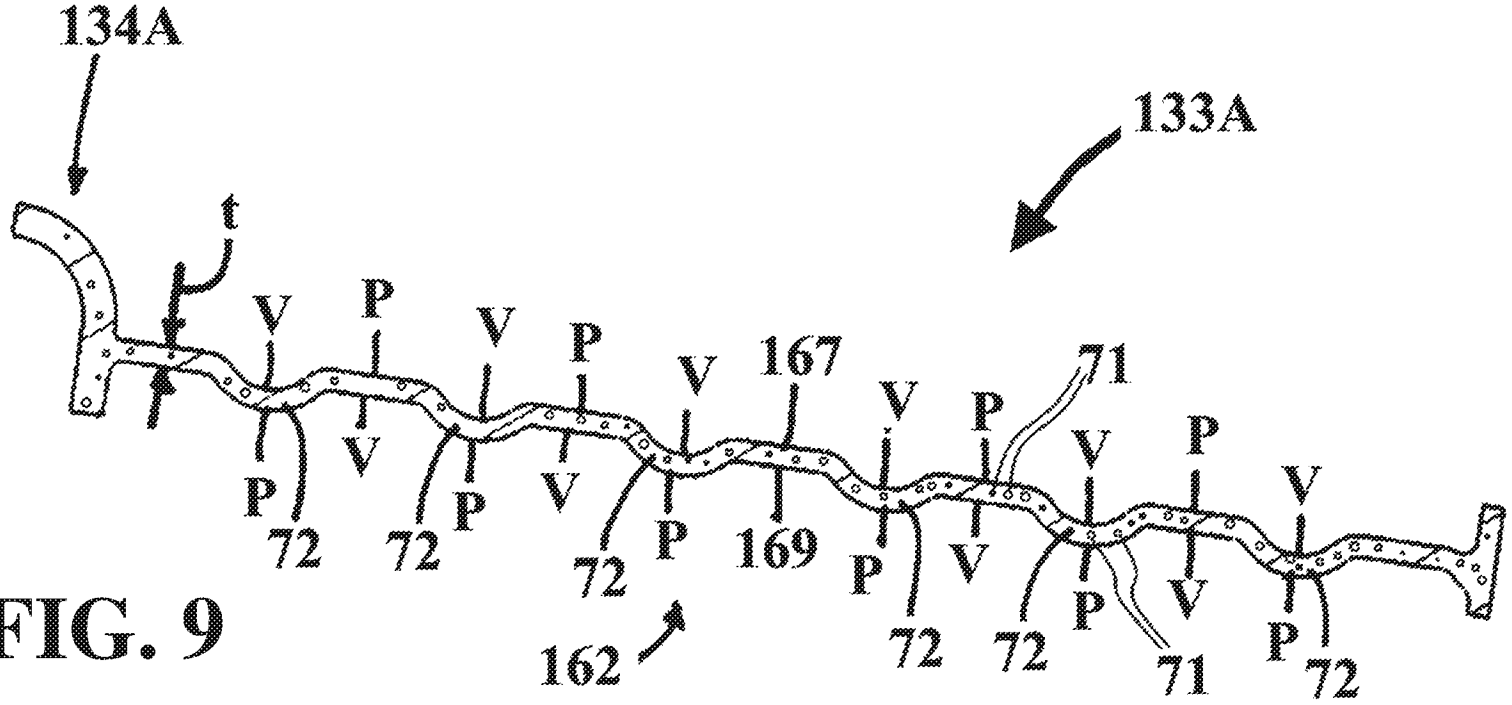
FIG. 9 illustrates a cross-sectional view taken generally along the ling 9-9 of FIG. 7.

The connector region 162 can be formed having at least one non-planar, undulating side 167, 169 to reduce the weight, material content and cost of the carrier member 133A and to enhance the strength and rigidity of the carrier member 133A, and is shown, by way of example and without limitation, as having non-planar, undulating opposite sides 167, 169 to maximize the reduction of the weight, material content and cost of the carrier member 133A. The undulating sides 167, 169 can be formed having a plurality of undulations 72, shown by way of example and without limitation as being generally rounded, sinusoidal shaped undulations 72. Undulations 72 may include glass fibers 71 extending through the plastic material forming the undulations 72. For example the glass fibers 71 may be configured to extend between first and second ends in a direction parallel or substantially parallel to the undulations 72. For example the glass fibers 71 may be configured to extend cross-wise 73. For example the glass fibers 71 may be configured to extend cross-wise 73 in a combination of lengthwise 75 and crosswise 73, for example in random directions depending on the injection point and flow direction of the plastic material during injection molding. Therefore glass fibers may be provided for in the non-planar portions e.g. undulations 72 in addition to the planar portions of the carrier members 133. Glass fibers 71 can further increase the strength of the plastic body material and due to the configuration of the undulations providing even transitions of uniform thickness such fibers can freely flow to be evenly distributed throughout the body B and/or undulations 72. Connector region 162 may also be provided with glass fibers 71 in a similar manner. Thus, the undulating sides 167, 169 are provided having a corrugated shape, where the corrugated shape can have peaks P and valleys V (FIG. 9) extending lengthwise between upper and lower ends 163, 165 of the carrier member 133A to enhance the strength and flexural stiffness of the carrier member 133A to resist deflection of the carrier member 133A as a window 46 is raised and lowered along the window regulator rail 134A of the carrier member 133A. As shown in FIG. 9, the carrier member 133A can be formed having a uniform material thickness (t) extending between the undulating opposite sides 167, 169 to reduce the weight, material content and cost of the carrier member. However, it is contemplated herein that the thickness t could vary, as desired, to provide the weight reduction and flexural stiffness and rigidity desired for the intended application.

Figure 10:
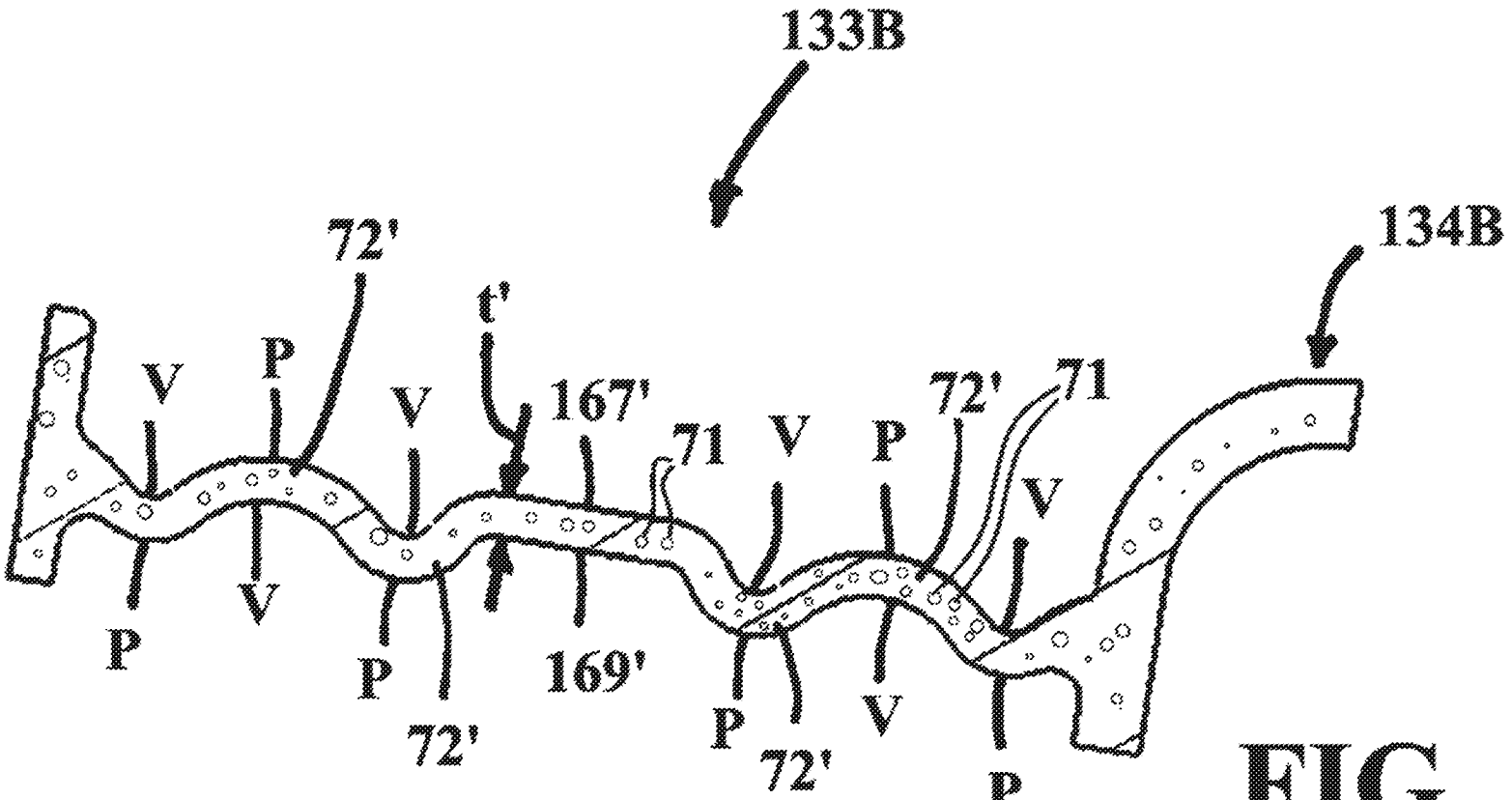
FIG. 10 illustrates a cross-sectional view taken generally along the ling 10-10 of FIG. 7.

As discussed above for carrier member 133A, carrier member 1336 can likewise be formed having at least one non-planar, undulating side 167', 169' to reduce the weight, material content and cost of the carrier member 133B and to enhance the strength and rigidity of the carrier member 1336, and is shown, by way of example and without limitation, as having non-planar, undulating opposite sides 167', 169' with a plurality of undulations 72' extending lengthwise along a body of carrier member 133B between opposite ends 163', 165' to maximize the reduction of the weight, material content and cost of the carrier member 133B. The undulating sides 167', 169' can be formed having a corrugated shape, where the corrugated shape can have peaks P and valleys V (FIG. 10) extending lengthwise between the upper and lower ends 163', 165' of the carrier member 1336 to enhance the strength and flexural stiffness of the carrier member 1336 to resist deflection of the carrier member 1336 as a window 46 is raised and lowered along the window regulator rail 134B of the carrier member 133B. As shown in FIG. 10, the carrier member 133B can be formed having a uniform material thickness (t') extending between the undulating opposite sides 167, 169 to reduce the weight, material content and cost of the carrier member. However, it is contemplated herein that the thickness t' could vary, as desired, to provide the weight reduction and flexural stiffness and rigidity desired for the intended application.

As a result, a lightweight yet strengthened rail 34A, 34B, 134A, 134B is provided which can endure high loading during up and down stall conditions. During an upward stall condition, the honeycomb patterned walls 66 and a plurality of undulations 72 allow for a structure that is lower in weight yet increased in strength to withstand the bending, bucking and collapsing of the rails 34A, 34B, 134A, 134B. The honeycomb patterned walls 66 and a plurality of undulations 72 provide strength which resist buckling and twisting, while the frame 89 is provided to add strength along the loading directions. Additionally, providing radially extending ribs 25 about the mounting point of pulleys 40, 42 acts to reinforce the mounting of the pulleys 40, 42 to the rails 34A, 34B, 134A, 134B, as well as strengthening the connection between the upper and lower ends 63, 65, 163, 165 and a body 79, 179 of the respective rail 34A, 34B, 134A, 134B. Providing a frame 89 around the honeycomb patterned walls 66 and plurality of undulations 72 provides strength along a loading direction LD as a result of the stall conditions.

Figure 11:
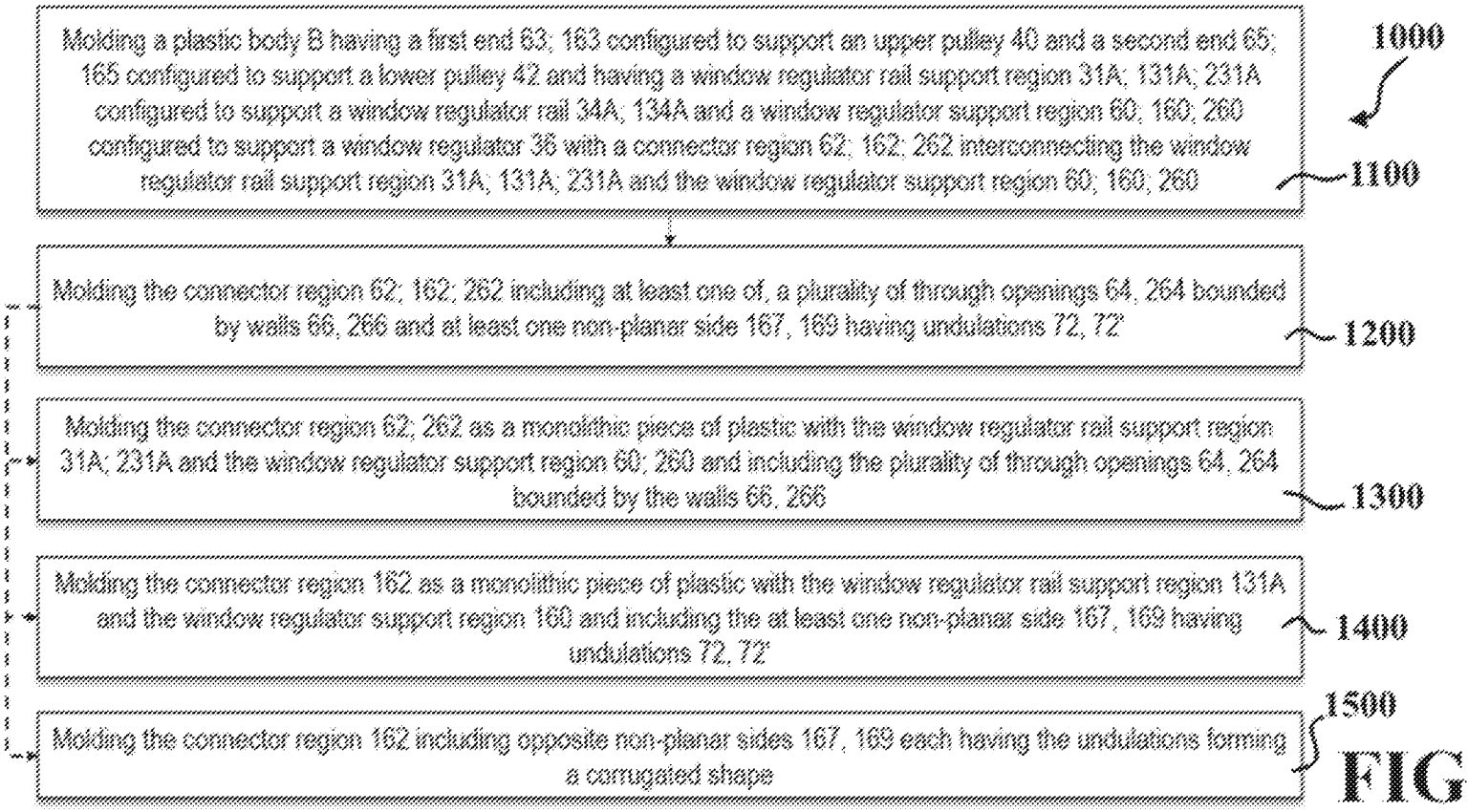
FIG. 11 illustrates a flow diagram of a method of constructing a carrier member for a carrier module for a motor vehicle door panel structure.

FIG. 11 illustrates a method 1000 of constructing a carrier member 33A, 133A, 233A for a carrier module for a motor vehicle 14 door panel structure 17 in accordance with another aspect of the disclosure. The method 1000 includes a step 1100 of molding a plastic body B having a first end 63; 163 configured to support an upper pulley 40 and a second end 65; 165 configured to support a lower pulley 42 and having a window regulator rail support region 31A; 131A; 231A configured to support a window regulator rail 34A; 134A and a window regulator support region 60; 160; 260 configured to support a window regulator 36 with a connector region 62; 162; 262 interconnecting the window regulator rail support region 31A; 131A; 231A and the window regulator support region 60; 160; 260. The method 1000 further includes a step 1200 of molding the connector region 62; 162; 262 including at least one of, a plurality of through openings 64, 264 bounded by walls 66, 266 and at least one non-planar side 167, 169 having undulations 72, 72'.

The method 1000 can further include a step 1300 of molding the connector region 62; 262 as a monolithic piece of plastic with the window regulator rail support region 31A; 231A and the window regulator support region 60; 260 and including the plurality of through openings 64, 264 bounded by the walls 66, 266.

The method 1000 can further include a step 1400 of molding the connector region 162 as a monolithic piece of plastic with the window regulator rail support region 131A and the window regulator support region 160 and including the at least one non-planar side 167, 169 having undulations 72, 72'.

The method 1000 can further include a step 1500 of molding the connector region 162 including opposite non-planar sides 167, 169 each having the undulations forming a corrugated shape.

While the above description constitutes a plurality of embodiments of the present invention, it will be appreciated that the present invention is susceptible to further modification and change without departing from the fair meaning of the accompanying claims.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A carrier module for a motor vehicle having outer and inner panels defining a door panel structure with an internal door cavity, said carrier module, comprising:

a pair of carrier members, each carrier member extending lengthwise between opposite first and second ends, said carrier members being operably coupled to one another via at least one cable, wherein at least one carrier member of said carrier members is formed of plastic material and includes at least one of, a plurality of through openings reducing a weight of said at least one carrier member with said plurality of through openings being bounded by walls enhancing the strength and rigidity of said at least one carrier member, at least one non-planar side having undulations enhancing weight reduction, strength and rigidity of said at least one carrier member, and a plurality of ribs bounding recessed pockets enhancing weight reduction, strength and rigidity of said at least one carrier member; and wherein said at least one carrier member has a window regulator rail support region configured to support a window regulator rail and a window regulator support region configured to support a window regulator and a connector region interconnecting said window regulator rail support region and said window regulator support region, said connector region being formed of a monolithic piece of plastic with said window regulator rail support region and said window regulator support region and including at least one of said plurality of through openings and said at least one non-planar side.

2. The carrier module of claim 1, wherein said connector region includes said plurality of through openings.

3. The carrier module of claim 2, wherein said walls bounding said plurality of through openings are honeycomb patterned.

4. The carrier module of claim 3, wherein said honeycomb patterned walls form a plurality of adjacent columns of said plurality of through openings extending lengthwise between upper and lower ends of said at least one carrier member.

5. The carrier module of claim 3, wherein said honeycomb patterned walls have at least one non-planar side.

6. The carrier module of claim 3, wherein said honeycomb patterned walls isolate said window regulator support region in spaced relation from said window regulator rail support region.

7. The carrier module of claim 1, wherein said connector region includes said at least one non-planar side.

8. The carrier module of claim 7, wherein said at least one non-planar side includes non-planar, undulating opposite sides having a corrugated shape.

9. The carrier module of claim 8, wherein said corrugated shape has peaks and valleys extending lengthwise between upper and lower ends of said at least one carrier member.

10. The carrier module of claim 9, wherein said connector region has a uniform material thickness extending between said opposite sides.

11. The carrier module of claim 1, wherein said at least one carrier member has opposite sides with at least one of said opposite sides including said plurality of ribs bounding said recessed pockets.

12. The carrier module of claim 11, wherein said at least one carrier member includes an upper pulley mounted about a first end and a lower pulley mounted about an opposite second end wherein said plurality of ribs are configured to extend radially away from said upper pulley and said lower pulley.

13. A carrier member for a carrier module of a motor vehicle door panel structure, comprising:

a body extending lengthwise between a first end of a window regulator rail support region configured to support an upper pulley and a second end of the window regulator rail support region configured to support a lower pulley, said body being formed of plastic material and including the window regulator rail support region configured to support a window regulator rail and a window regulator support region configured to support a window regulator and a connector region interconnecting said window regulator rail support region and said window regulator support region, said connector region including at least one of, a plurality of through openings bounded by walls and at least one non-planar side having undulations.

14. The carrier member of claim 13, wherein said connector region is formed of a monolithic piece of plastic with said window regulator rail support region and said window regulator support region and includes said plurality of through openings bounded by said walls.

15. The carrier member of claim 13, wherein said connector region is formed of a monolithic piece of plastic with said window regulator rail support region and said window regulator support region and includes said at least one non-planar side having undulations.

16. A carrier member for a carrier module of a motor vehicle door panel structure, the carrier member comprising:

a body extending lengthwise between a first end configured to support an upper pulley and a second end configured to support a lower pulley, said body being formed of plastic material and including at least one non-planar side having a plurality of undulations enhancing weight reduction, strength and rigidity of the carrier member, said plurality of undulations forming a corrugated shape having alternating peaks and valleys extending lengthwise between the first end and the second end.

17. The carrier member of claim 16, wherein the body further includes radially extending ribs about a mounting point for each pulley.

18. The carrier member of claim 16, wherein the undulations have uniform material thickness extending between opposite sides of the carrier member.

19. The carrier member of claim 16, wherein the undulations are sinusoidal shaped.

20. A carrier module for a motor vehicle having outer and inner panels defining a door panel structure with an internal door cavity, said carrier module, comprising:

a pair of carrier members, each carrier member extending lengthwise between opposite first and second ends, said carrier members being operably coupled to one another via at least one cable and each being connectable directly to one of the outer and inner panels, wherein at least one carrier member of said carrier members is formed of plastic material and includes at least one of, a plurality of through openings reducing a weight of said at least one carrier member with said plurality of through openings being bounded by walls enhancing the strength and rigidity of said at least one carrier member, at least one non-planar side having undulations enhancing weight reduction, strength and rigidity of said at least one carrier member, and a plurality of ribs bounding recessed pockets enhancing weight reduction, strength and rigidity of said at least one carrier member.

* * * * *